US008261637B2

(12) United States Patent
Huang

(10) Patent No.: US 8,261,637 B2
(45) Date of Patent: Sep. 11, 2012

(54) REDIRECTION STRUCTURE OF RATCHET WRENCH

(75) Inventor: Ping-Wen Huang, Wurih Township (TW)

(73) Assignee: New Way Tools Co., Ltd., Taichung (TW)

( * ) Notice: Subject to any disclaimer, the term of this patent is extended or adjusted under 35 U.S.C. 154(b) by 546 days.

(21) Appl. No.: 12/607,025

(22) Filed: Oct. 27, 2009

(65) Prior Publication Data

US 2011/0094351 A1 Apr. 28, 2011

(51) Int. Cl.
*B25B 13/46* (2006.01)

(52) U.S. Cl. ..... 81/63.2; 81/61; 81/63.1

(58) Field of Classification Search ..... 81/61, 63.1, 81/63.2
See application file for complete search history.

(56) References Cited

U.S. PATENT DOCUMENTS

2003/0121372 A1* 7/2003 Huang ..... 81/63.2
2009/0193944 A1* 8/2009 Yang ..... 81/465
* cited by examiner

*Primary Examiner* — Lee D Wilson
*Assistant Examiner* — Shantese McDonald
(74) *Attorney, Agent, or Firm* — Wang Law Firm, Inc.; Li K. Wang

(57) ABSTRACT

An improved redirection structure of a ratchet wrench is disclosed. A driving head accommodates a connector body that has a knob. The accommodating room of the connector body accommodates a brake block with a notch. The urging element of the knob urges against the brake block in the notch.

4 Claims, 7 Drawing Sheets

REDIRECTION STRUCTURE OF RATCHET WRENCH

BACKGROUND OF THE INVENTION

1. Field of Invention

The invention relates to a ratchet wrench structure and, in particular, to an improved redirection structure that enables a ratchet wrench to change its rotational direction.

2. Related Art

FIG. 6 shows a conventional ratchet wrench structure. As shown in the drawing, the driving head 80 of the wrench 8 is accommodated with a brake block 82 engaged with the inner tooth part 81 inside the driving head 80. The brake block 82 is urged by an urging element 83 in the driving head 80 to be in a brake position. However, in order for the brake block 82 to be accommodated in the driving head 80, the driving head must be designed to have an accommodating space 84 for the brake block 82 and other elements. Therefore, the driving head 80 of the conventional ratchet wrench usually has a certain specification, so that the brake block 82 can be disposed therein.

FIGS. 7 and 8 shows another conventional ratchet wrench structure. One end of the wrench 9 has a driving head 90 which has an inner tooth part 91 therein. The driving head 90 is accommodated with a connector body 92. An accommodating space 93 is formed between the connector body 92 and the driving head 90 to accommodate a brake block 94. The driving head 90 is provided with a knob 95 for changing the rotational direction of the connector body 92. The elastic element 96 is connected between the knob 95 and the brake block 94, so that the rotated knob 95 changes the brake direction of the brake block 94 and positions it. The connector head 92 is positioned inside the driving head 90 by a buckle 97 on both sides of the driving head 90, respectively. As shown in FIG. 8, the tooth part 941 of the brake block 94 urges against the inner tooth part 91 of the driving head 90 because of the support of the elastic element 96. However, the elastic element 96 has the problem of elastic fatigue after some time of use. Therefore, the brake block 94 may not move smoothly in the driving head 90.

Therefore, the invention aims to resolve the space occupied by the brake block 82 in the driving head 80 of the conventional ratchet wrench 8, and to improve the braking strength of the brake block 94 in the conventional ratchet wrench 9.

SUMMARY OF THE INVENTION

An objective of the invention is to provide an improved redirection structure of the ratchet wrench. By accommodating the redirection axle of the knob in the notch of the brake block, the driving head saves more space in holding the brake block than the conventional ratchet wrench. So the disclosed driving head is smaller than the conventional one. Besides, the notch of the brake block accommodates the redirection axle of the knob. By turning the knob, the urging element urges against the brake block to change the rotational direction of the connector body. Therefore, the invention has a better strength than the conventional wrench where an elastic element is used as the reciprocal support. The brake block thus moves smoothly because there is no elastic fatigue problem.

To achieve the above-mentioned objective, the invention includes: a driving head, a connector body, a brake block, and a knob.

The driving head is located on one end of the wrench. It is formed with a longitudinal through hole.

The connector body is inserted into and positioned in the longitudinal through hole of the driving head. The connector body is formed with an accommodating room on its annular side. The center on one end of the connector body is inserted with a longitudinal accommodating groove in communication with the accommodating room. The other end of the connector body has the working head to be connected with a passive element. The inner wall of the longitudinal accommodating groove of the connector body has two concave parts.

The brake block is disposed in the accommodating room of the connector body. The outer edge of the brake block has at least one outer tooth. The inner wall of the longitudinal through hole of the driving head is formed with an inner tooth part. When the brake block is in action, its outer tooth matches with the inner tooth part. The brake block has a notch therein. Both sides of the notch have a limiting part, respectively. A positioning part is provided by the notch near each of the limiting parts.

The knob has a toggle part and a redirection axle extended from the toggle part. The redirection axle is disposed in the longitudinal accommodating groove of the connector body and goes into the notch of the brake block. The position on the redirection axle opposite to the accommodating room of the connector body is formed with a through axle hole. A ball is disposed on the end of the axle hole near the connector body. An urging element is disposed on the end of the axle hole near the brake block. Both ends of an elastic element in the axle hole urge the ball and the urging element, respectively. When one turns the knob, the urging element is stopped by the two limiting parts to slide between the two positioning parts. When the urging element urges the positioning parts, the ball on the opposite end falls into and gets positioned in the concave part.

BRIEF DESCRIPTION OF THE DRAWINGS

The invention will become more fully understood from the detailed description given herein below illustration only, and thus is not limitative of the present invention, and wherein.

DETAILED DESCRIPTION OF THE INVENTION

Figure 1:
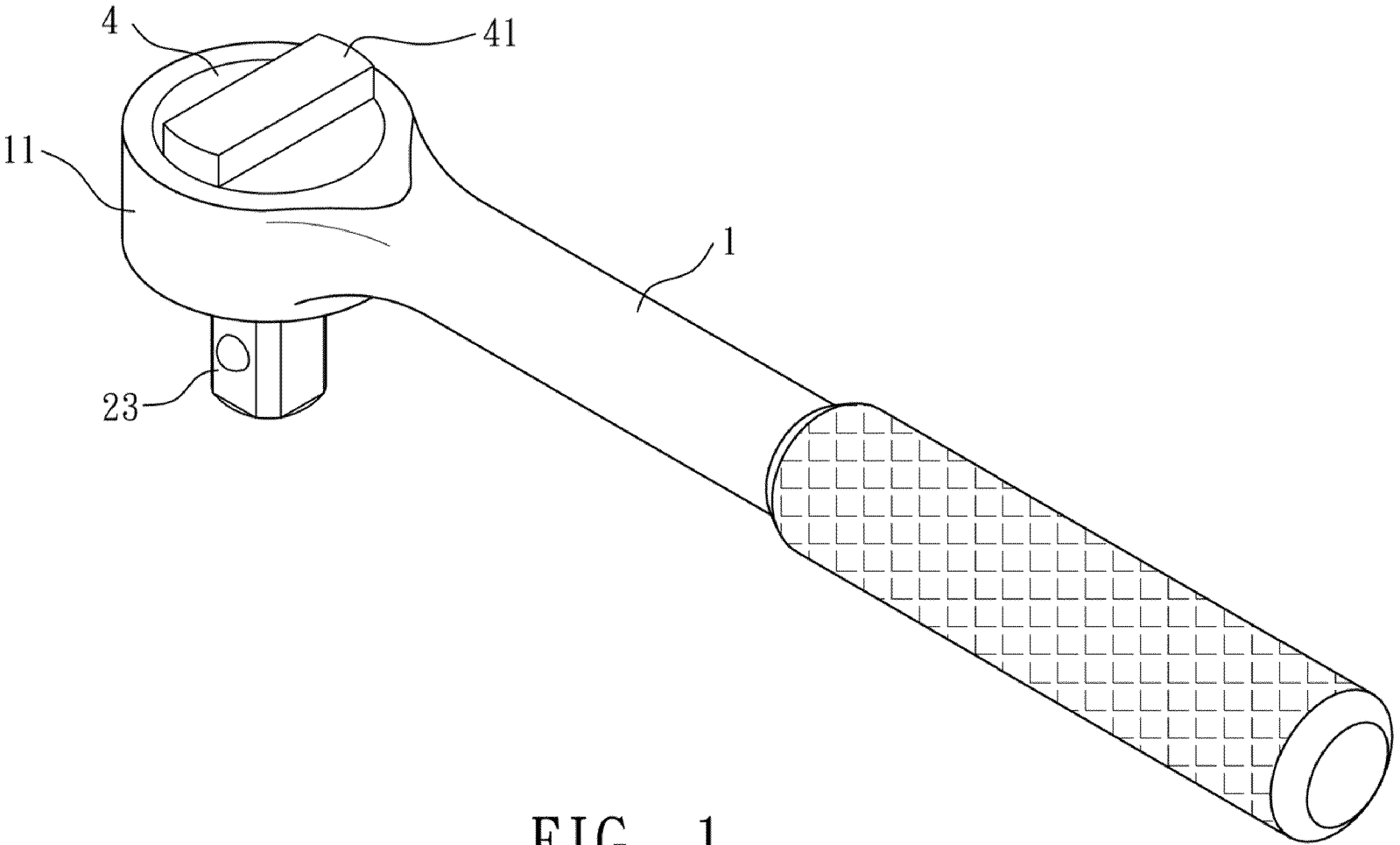
FIG. 1 is a three-dimensional perspective view of the disclosed ratchet wrench.
Figure 2:
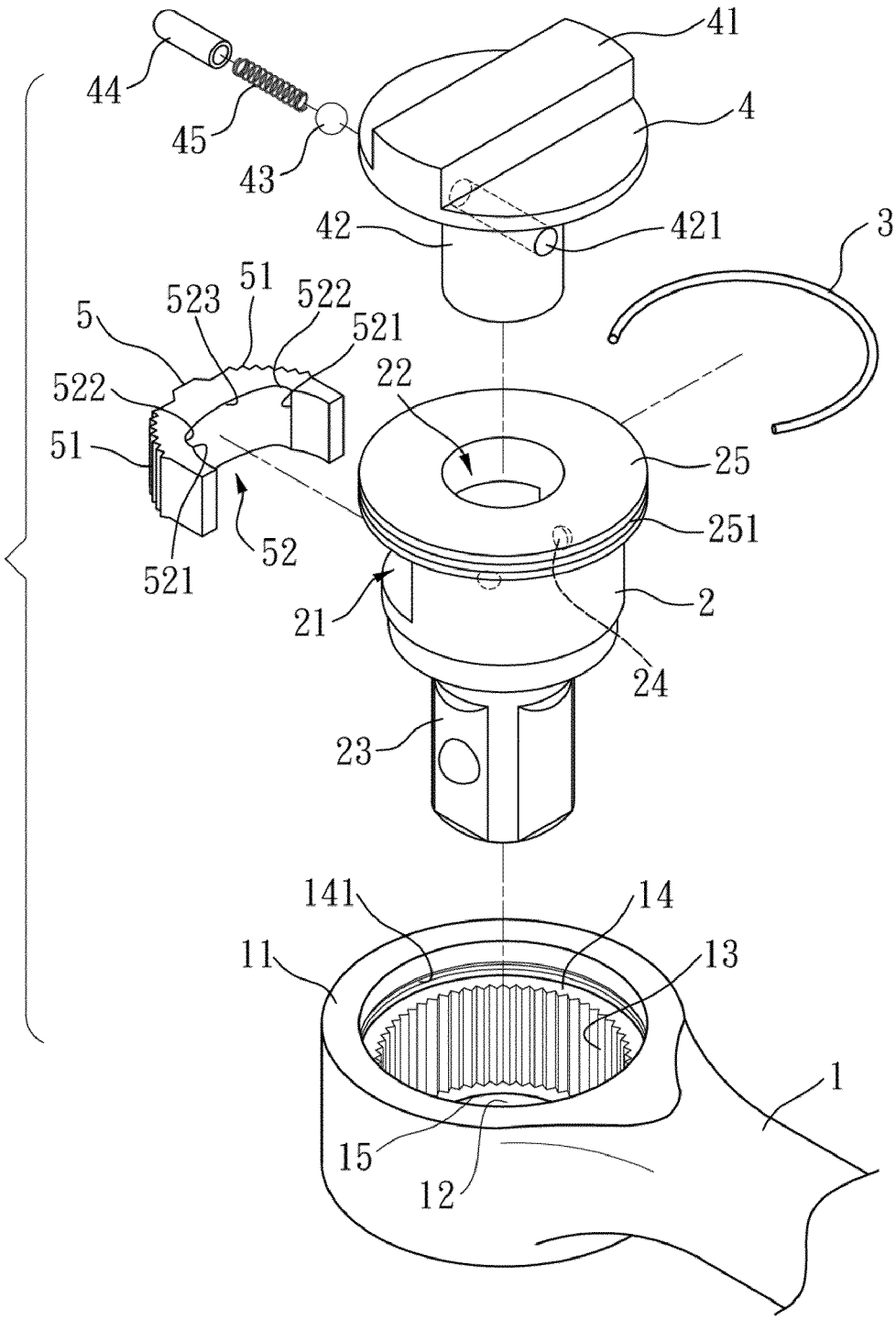
FIG. 2 is a three-dimensional exploded view of the disclosed ratchet wrench.

The present invention will be apparent from the following detailed description, which proceeds with reference to the accompanying drawings, wherein the same references relate to the same elements.

Please refer to FIGS. 1 to 6 for an embodiment of the invention. This embodiment of the invention provides an improved redirection structure of a ratchet wrench, which includes: a driving head 11, a connector body 2, a knob 4, and a brake block 5.

The driving head 11 is on one end of a wrench 1. A longitudinal through hole 12 is formed between two side surfaces of the driving head 11. The inner ring surface of the longitudinal through hole 12 of the driving head 11 is formed with an inner tooth part 13. In this embodiment, one side of the driving head 11 has a concave ring 14 coaxial with the inner tooth part 13. The other side has a stopping part 15 whose inner hole is smaller than that of the inner tooth part 13. The concave ring 14 is provided with a first groove 141.

The connector body 2 penetrates into and gets positioned in the longitudinal through hole 12 of the driving head 1. The connector body 2 is annular formed with an accommodating room 21. A longitudinal accommodating groove 22 is form from the center of one end of the connector body 2 inward and in communication with the accommodating room 21. The other end of the connector body 2 is extended with a working head 23. The inner wall of the longitudinal accommodating groove 22 of the connector body 2 has two concave parts 24. The working head 23 is to be connected with a passive element, which is not shown in the drawing. The passive element refers to an element that is directly or indirectly locked. For example, it can be an inner hex screw to be fastened by the working head 23 with a cylinder or some other element that can be fastened directly by the working head 23.

In this embodiment, the connector body 2 is provided with a stopping part 15 with a larger diameter on the end disposed with the working head 23. The stopping part 15 stops the connector body 2 in the driving head 11. The other end of the working head 23 is horizontally extended with an annular part 25. The annular part 25 is annularly formed with a second groove 251. A buckle 3 catches the first groove 141 and the second groove 251 when the connector body 2 is inserted in the driving head 11. The connector body 2 is thus restricted and positioned in the longitudinal through hole 12 of the driving head 11.

The knob 4 has a toggle part 41 and a redirection axle 42 extended from the toggle part 41. The redirection axle penetrates through the longitudinal accommodating groove 22 of the connector body 2 and goes into the notch 52 of the brake block 5.

The brake block 5 is disposed in the accommodating room 21 of the connector body 2. The outer edge of the brake block 5 has at least one outer tooth 51. When the brake block 5 functions, its outer tooth engages with the inner tooth part 13 of the driving head 11. The brake block 5 has a notch 52 therein. The brake block 5 has a limiting part 521 on both sides of the notch 52, respectively. Moreover, a positioning part 522 is provided near each of the limiting part 521 around the notch 52.

In this embodiment, a through axle hole 421 is formed on the redirection axle 42 corresponding to the accommodating room 21 of the connector body 2. A ball 43 is disposed on the end of the axle hole 421 near the connector body 2. An urging element 44 is disposed on the end of the axle hole 421 near the brake block. Both ends of an elastic element 45 in the axle hole 421 urge against the ball 43 and the urging element 44. The urging element 44 is stopped by the two limiting parts 521 to slide between the two positioning parts 522 as the knob 4 is turned. When the urging element 44 urges against each of the positioning parts 522, the ball 43 on the end opposite to the urging element 44 falls into and gets positioned in the concave part 24 on the opposite side.

Also, in this embodiment, the notch 52 of the brake block 5 has a U shape. The two limiting parts 521 provided relative to the notch 52 on the brake block 5 are near the nearby corners, respectively. A guiding section 523 for the urging element 43 to slide is formed between the two limiting parts 521. The two positioning parts 522 are at the corners of the U-shaped brake block 5, connecting the corresponding limiting parts 521 and the guiding section 523.

Figure 3:
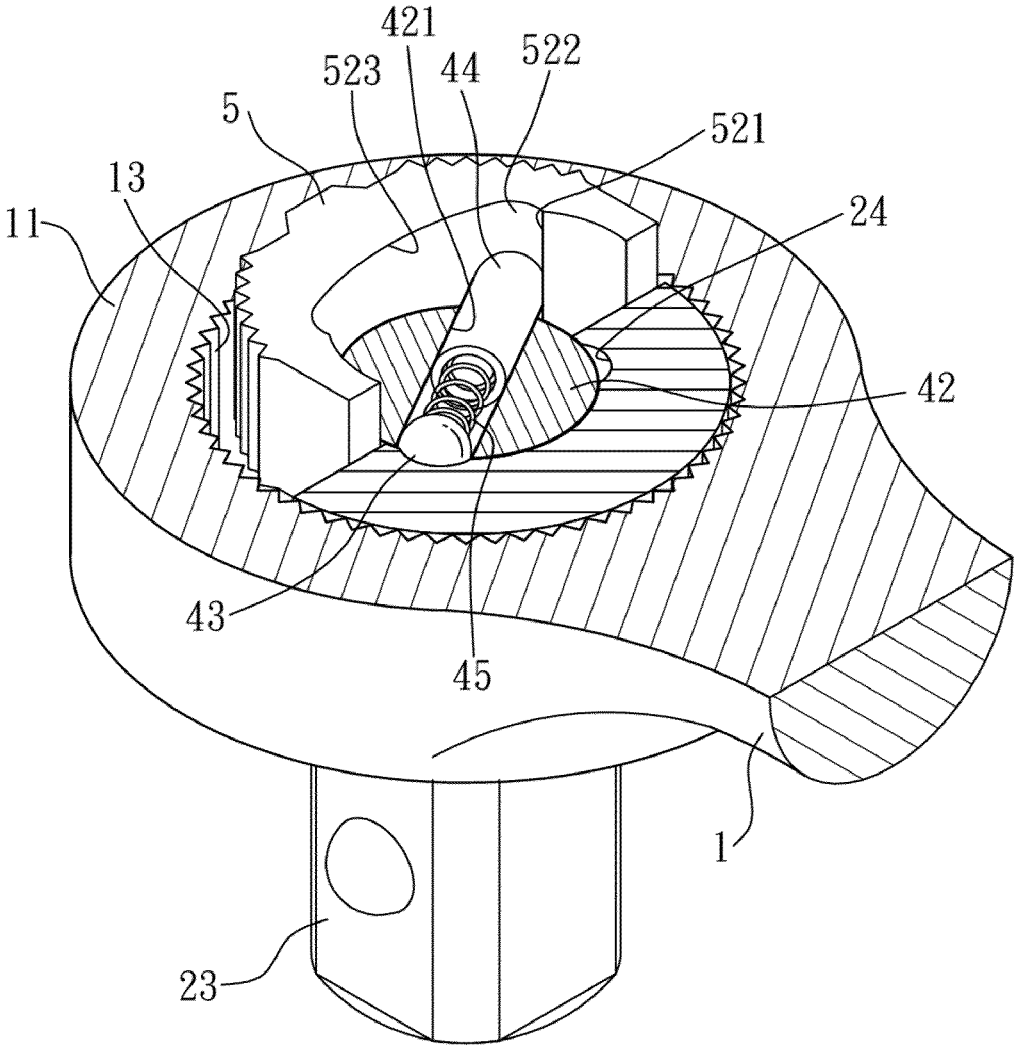
FIG. 3 is a three-dimensional cross-sectional view of the disclosed ratchet wrench.

According to the above-mentioned structure, the redirection axle 42 of the knob 4 goes into the longitudinal groove 22 of the connector body 2. When the brake block 5 is disposed into the driving head 11 and in the accommodating room 21 of the connector body 2, the notch 52 of the brake block 5 can accommodate the redirection axle 42 of the knob 4. As shown in FIG. 3, when the driving head 11 accommodates the brake block 5, the distance between the redirection axle 42 and the brake block 5 is shorter. This in turn reduces the accommodating space of the driving head 11. Therefore, it saves more space than the conventional ratchet wrench. The disclosed driving head 11 is thus designed to be smaller than the conventional driving head.

Figure 4:
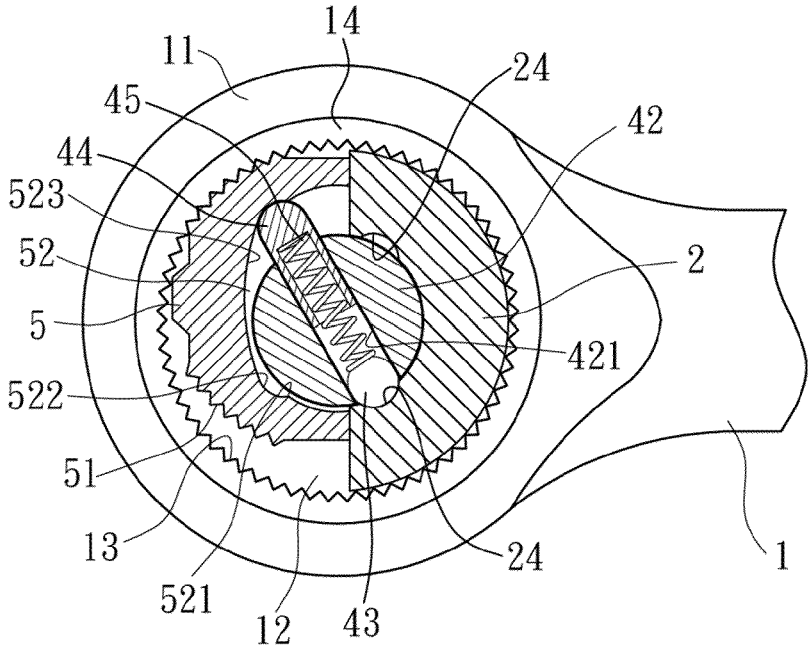
FIG. 4 is a cross-sectional view of the first driving head in use according to the invention.
Figure 5:
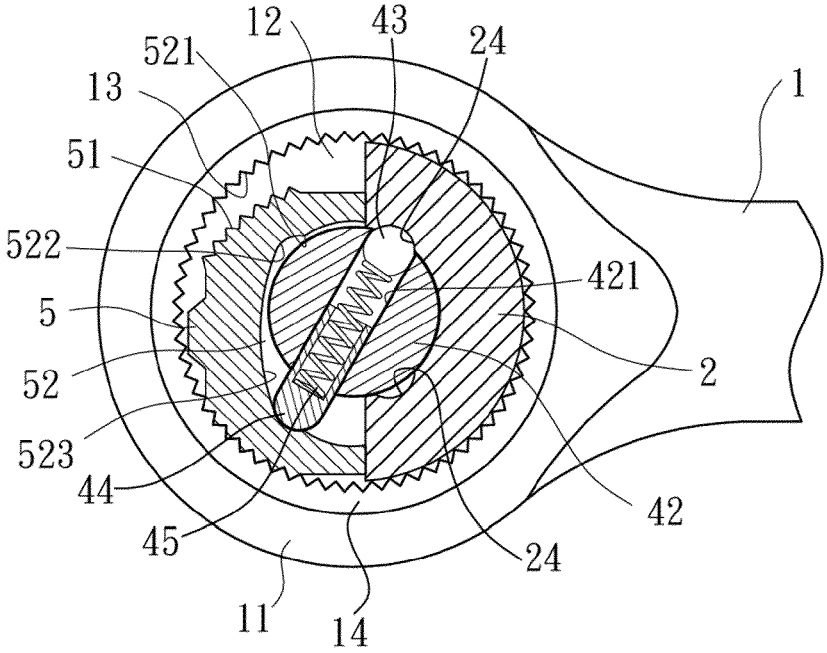
FIG. 5 is a cross-sectional view of the second driving head in use according to the invention.
Figure 6:
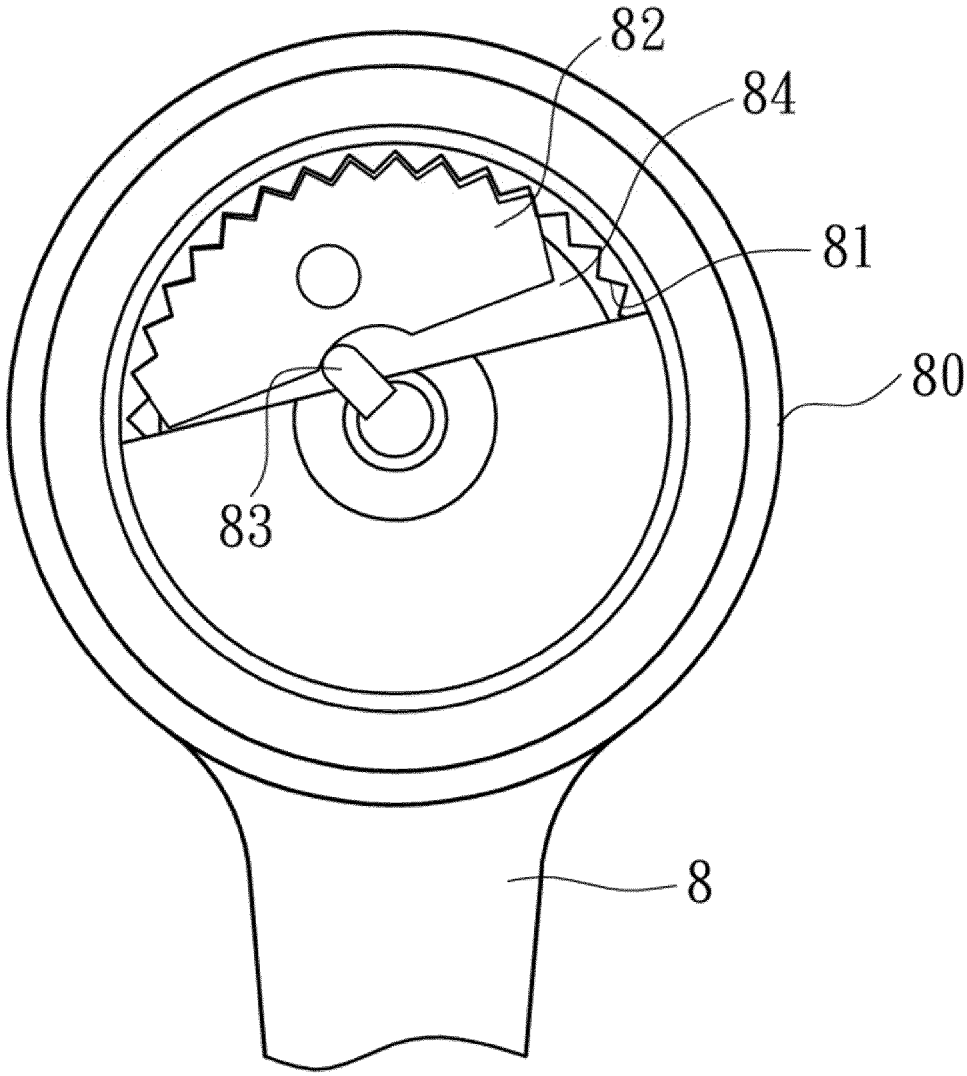
FIG. 6 PRIOR ART
FIG. 6 is a planar cross-sectional of a conventional ratchet wrench.
Figure 7:
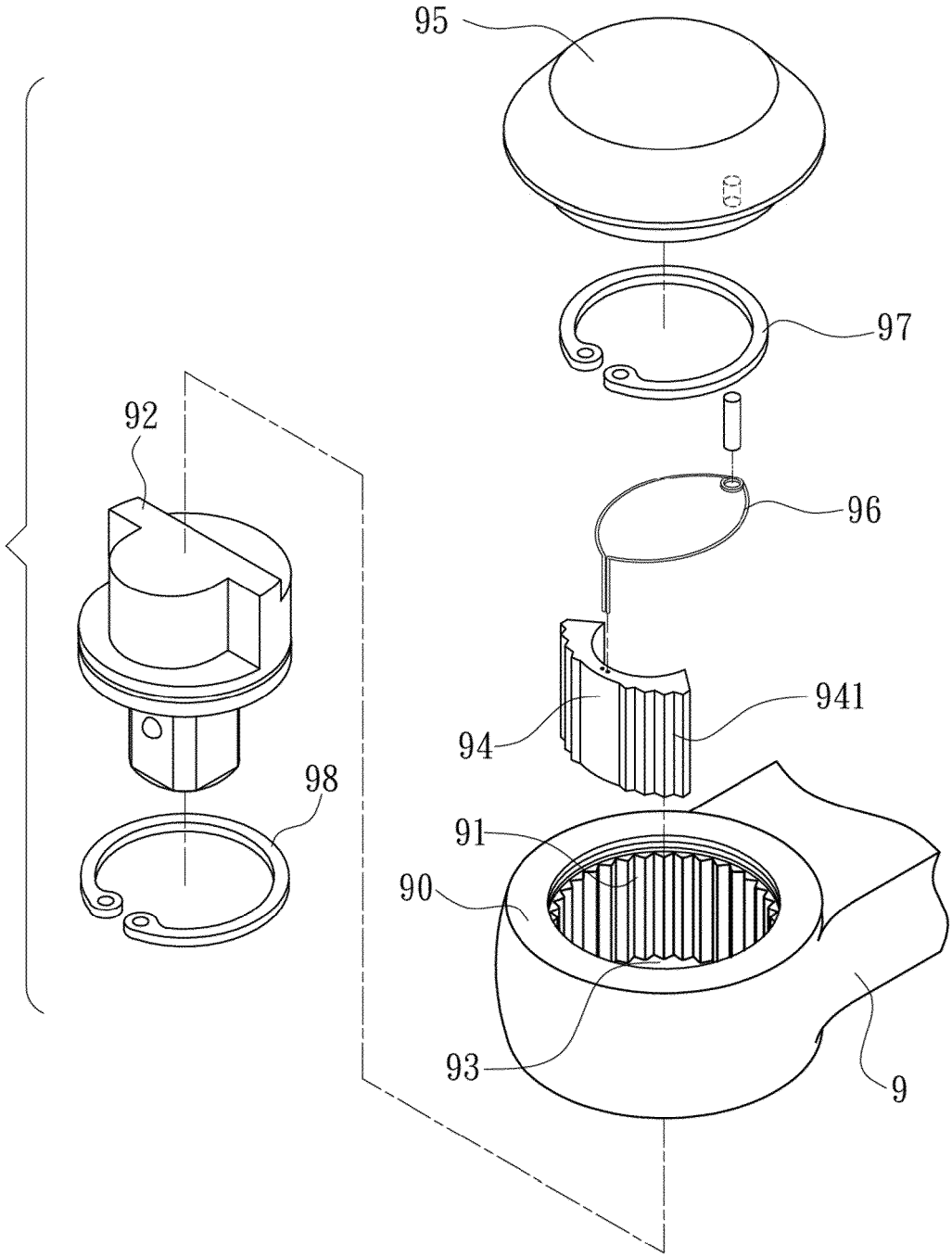
FIG. 7 PRIOR ART
FIG. 7 is a three-dimensional exploded view of another conventional ratchet wrench.
Figure 8:
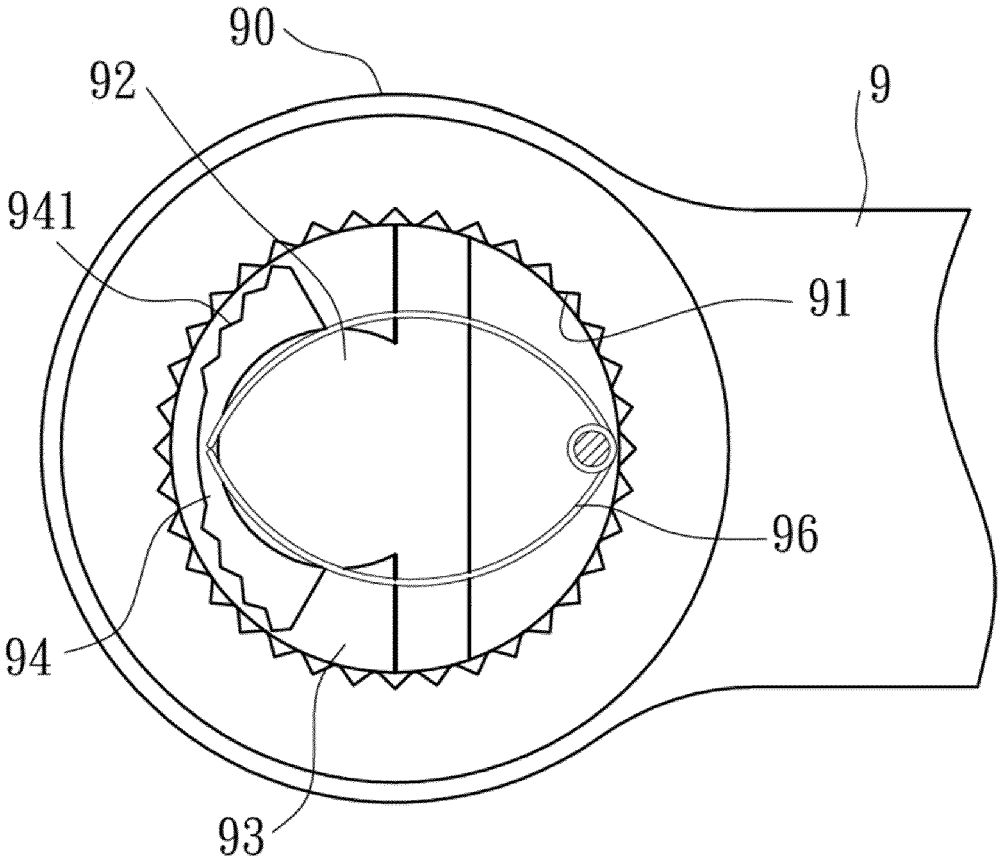
FIG. 8 PRIOR ART
FIG. 8 is a planar cross-sectional view of the conventional ratchet wrench in FIG. 7.

Furthermore, as shown in FIGS. 4 and 5, the brake block 5 is urged by the urging element 44 of the knob 4 in the accommodating room 21 of the connector body 2. Besides, the connector body 2 has two concave parts on the inner wall of the longitudinal accommodating groove 22, so that the ball 43 falls in and gets positioned when the knob 4 is turned to the end part position. Therefore, after the knob 4 is turned, the ball 43 falls into the concave part 24 and the urging element 44 urges against the positioning part 522. The brake block 5 is positioned more firmly. This ensures the engagement between the outer tooth 51 of the brake block 5 and the inner tooth part 13 of the driving head 11. By turning the knob 4, one can change the brake direction. The urging element 44 of the knob 4 urges against the brake block 5 directly. Therefore, it is not like the conventional ratchet wrench that requires an elastic element to constrain the brake block. The disclosed ratchet wrench has a better brake strength than the conventional ratchet wrench. This avoids the problem that the brake block 5 does not move smoothly in the driving head 11 due to elastic fatigue.

Although the invention has been described with reference to specific embodiments, this description is not meant to be construed in a limiting sense. Various modifications of the disclosed embodiments, as well as alternative embodiments, will be apparent to people skilled in the art. Therefore, it is contemplated that the appended claims will cover all modifications that fall within the true scope of the invention.

What is claimed is:

1. An improved redirection structure of a ratchet wrench, comprising:

a driving head, which is disposed on the end part of the wrench and is formed with a longitudinal through hole;

a connector body, which penetrates into and gets positioned in the longitudinal through hole of the driving head, is annularly formed with an accommodating room, is formed with a longitudinal accommodating groove from the center of one end inward to connect with the accommodating room, extends with a working head on the other end to be connected with a passive element, and has two concave parts on the inner wall of the longitudinal accommodating groove;

a brake block, which is disposed in the accommodating room of the connector body, has at least an outer tooth on its outer edge, the outer tooth engaging with an inner tooth part formed annularly on the inner sidewall of the longitudinal through hole of the driving head, and has a notch therein, a limiting part on each side of the notch, and a positioning part near each of the limiting parts around the notch; and a knob, which has a toggle part and a redirection axle extended from the toggle part, the redirection axle penetrating into the longitudinal accommodating groove of the connector body and going into the notch of the brake block;

wherein the redirection axle has a through axle hole opposite to the accommodating room of the connector body; a ball is disposed on the end of the axle hole near the connector body, an urging element is disposed on the end of the axle hole near the brake block; both ends of an elastic element in the axle hole urge against the ball and the urging element, respectively; the urging element is stopped by the two limiting parts to slide between the two positioning parts as the knob is turned; and when the urging element urges against the positioning parts, the ball on the opposite end of the urging element falls in and gets positioned in the concave part of the opposite side.

2. The improved redirection structure of a ratchet wrench according to claim 1, wherein one side surface of the driving head is formed with a concave ring coaxial with the inner tooth part, the other side surface is annularly formed with a stopping part with an inner hole smaller than the inner tooth part, the diameter of the concave ring is greater than that of the inner tooth part, and the concave ring is annularly formed with a first groove.

3. The improved redirection structure of a ratchet wrench according to claim 2, wherein the end of the working head on the connector body has a diameter greater than that of the stopping part, the stopping part stops the connector body in the driving head, the other end of the working head is formed with an annular part horizontally outward, the annular part is annularly formed with a second groove, and a buckle catches the first groove and the second groove when the connector body is inserted into the driving head so that the connector body is limited and positioned in the longitudinal through hole of the driving head.

4. The improved redirection structure of a ratchet wrench according to claim 1, wherein the notch of the brake block has a U shape, the two limiting parts are on both sides of the corner of the roughly U-shaped brake block, a guiding section is formed between the two limiting parts for the urging element to slide in between, and the two positioning parts are at the two corners of the U-shaped brake block to connect the corresponding limiting parts and the guiding section.

* * * * *